US006061035A

United States Patent [19]

Kinasewitz et al.

[11] Patent Number: 6,061,035

[45] Date of Patent: May 9, 2000

[54] FREQUENCY-SCANNED END-FIRE PHASED-ARAY ANTENNA

[75] Inventors: Robert T. Kinasewitz, New York, N.Y.; Leo DiDomenico, Ann Arbor, Mich.

[73] Assignee: The United States of America as represented by the Secretary of the Army, Washington, D.C.

[21] Appl. No.: 09/053,860

[22] Filed: Mar. 22, 1998

Related U.S. Application Data

[60] Provisional application No. 60/040,904, Apr. 2, 1997.

[51] Int. Cl.[7] ..... H01Q 21/00

[52] U.S. Cl. ..... 343/853; 343/700 MS; 343/770

[58] Field of Search ..... 343/853, 850, 343/700 MS, 767, 770; H01Q 21/00

[56] References Cited

U.S. PATENT DOCUMENTS

| | | | |
|---|---|---|---|
| 3,434,139 | 3/1969 | Algeo | 343/768 |
| 5,227,808 | 7/1993 | Davis | 343/767 |
| 5,519,408 | 5/1996 | Schnetzer | 343/770 |
| 5,557,291 | 9/1996 | Chu et al. | 343/770 |

OTHER PUBLICATIONS

"Frequency Scanning Microstrip Antennas", by Magnus Danielsen and Rolf Jorgensen, in IEEE Transactions on Antennas and Propagation, vol. AP–27, No. 2, Mar. 1979, pp. 146–150.

"Microwave Scanning Antennas", by R.C. Hansen, vol. 3, chapter two by N.A. Begovich, Academic press, 1966.

"Microwave Circuits and Antennas", by D.S. Sazonov, MIR Publishers, Moscow, 1990, pp. 22–29.

"Phased–Array Radars", by Eli Brookner, Scientific American, unspecified date, pp. 94–102.

*Primary Examiner*—Hoanganh Le
*Attorney, Agent, or Firm*—John F. Moran; Michael C. Sachs

[57] ABSTRACT

A frequency-scanned end-fire phased-array antenna includes a board, a sinuous transmission line formed on the board, a plurality of end-fire antennas, and a plurality of couplers corresponding to the end-fire antennas, such that the transmission line is selectively coupled to the plurality of end-fire antennas via the plurality of couplers, for selectively coupling energy within the transmission line to the end-fire antennas. By varying the input frequency to the antenna over a narrow range, the direction of a main radiation beam emitted by the antenna can be scanned ±90 degrees from broadside. A single antenna board produces a frequency-scanned fan beam. Stacked antenna boards can produce a frequency-scanned pencil beam, or several independent frequency-scanned fan beams at different frequencies. The present antenna can operate in the microwave, millimeter-wave, terahertz, infrared, or optical frequency range. Because this frequency-scanned phased-array can be mass produced by planar fabrication techniques, it can be much smaller and less expensive than conventional "hollow pipe" waveguide frequency-scanned phased-array antennas.

40 Claims, 6 Drawing Sheets

FREQUENCY-SCANNED END-FIRE PHASED-ARAY ANTENNA

This application claims benefit of the filing date of provisional application Ser. No. 60/040,904 filed on Apr. 2, 1997.

The invention described herein may be manufactured and used by or for the Government of the United States for governmental purposes.

FIELD OF THE INVENTION

The present invention relates in general to antennas, and it more specifically relates to a sinuous, frequency-scanned, end-fire, planar phased-array antenna.

BACKGROUND OF THE INVENTION

Frequency-scanned phased-array antennas are well known in the field and are usually operated at bandwidths that are at least a few percent. The traditional frequency-scanned phased array antenna using "hollow pipe" electromagnetic waveguide is described in detail in the book titled "Microwave Scanning Antennas", by R. C. Hansen, Vol.3, chapter two, Academic press, 1966. Although this technology has been very successful, it has limited present day applications because "hollow pipe" waveguide elements are too voluminous for the solid state, printed circuitry requirements now in widespread use for microwave and millimeter-wave radars. In addition, the bandwidths required (usually grater than six percent) are too large for practical solid-state millimeter-wave radars, which significantly limits the commercial applications of this technology.

FIG. 1 illustrates a more recent prior art frequency-scanned phased-array antenna 10 shown using electromagnetic transmission line 12 such as a microstrip. The operation of the frequency-scanned phased-array antenna 10 is described in greater detail in the article titled "Frequency Scanning Microstrip Antennas", by Magnus Danielsen and Roff Jorgensen, in IEEE Transactions on Antennas and Propagation, Vol. AP-27, No. 2, March 1979, pages 146–150, which article is incorporated herein by reference.

The Danielsen et al. article proposes a frequency-scanned phased-array antenna design where the transmission line 12 is formed of a plurality of segments, i.e., 14, 15, 16 that meander back and forth between successive patch radiating resonators, i.e., 18, 19, 20, 21. This meandering increases the electrical length of the transmission line segments between successive patch resonators. Therefore, the phase shift imparted by the transmission line 12 to a traveling wave is likewise substantially increased. In addition it should be noted that each patch resonator itself imparts a significant phase shift to the traveling wave.

However, the physical length and the electrical length of each microstrip transmission line segment 14, 15, 16 is limited by the geometry of the patch resonators 18, 19, 20, 21, so that the bandwidths required for a +45 degree to −45 degree-scan range still remain greater than six percent.

SUMMARY OF THE INVENTION

An object of the present invention is to provide a frequency-scanned phased-array antenna that can achieve a +45 degree to −45 degree scan range using a sinuous planar transmission line with a frequency bandwidth of one percent or less.

It is another object of the present invention to obtain the largest variation in the electrical length of the sinuous transmission line for the smallest variation in frequency. The antenna of the present invention further provides a rugged frequency scanned phased array.

The present antenna significantly reduces the size and cost of phased-array antennas, and expands their potential use in numerous commercial applications. For instance the present antenna may be used in a variety of applications including but not limited to missiles, smart munitions, anti-collision devices for vehicles, sensors, general aviation, communications systems, etc.

According to this invention, the frequency-scanned end-fire phased-array antenna includes a board, a sinuous transmission line formed on the board, a plurality of end-fire antennas, and a plurality of couplers corresponding to the end-fire antennas, such that the transmission line is selectively coupled to the plurality of end-fire antennas via the plurality of couplers, for selectively coupling energy within the transmission line to the end-fire antennas.

By varying the input frequency to the antenna over a narrow range, the direction of a main radiation beam emitted by the antenna can be scanned ±90 degrees from broadside. A single antenna board produces a frequency-scanned fan beam. Stacked antenna boards can produce a frequency-scanned pencil beam, or several independent frequency-scanned fan beams at different frequencies. The present antenna can operate in the microwave, millimeter-wave, terahertz, infrared, or optical frequency range. Because this frequency-scanned phased-array can be mass produced by planar fabrication techniques, it can be much smaller and less expensive than conventional hollow pipe waveguide frequency-scanned phased-array antennas.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawing. It should be understood that the sizes of the different components in the figures may not be in exact proportion, and are shown for visual clarity and for the purpose of explanation.

DETAILED DESCRIPTION OF PREFERRED EMBODIMENTS

Figure 1:
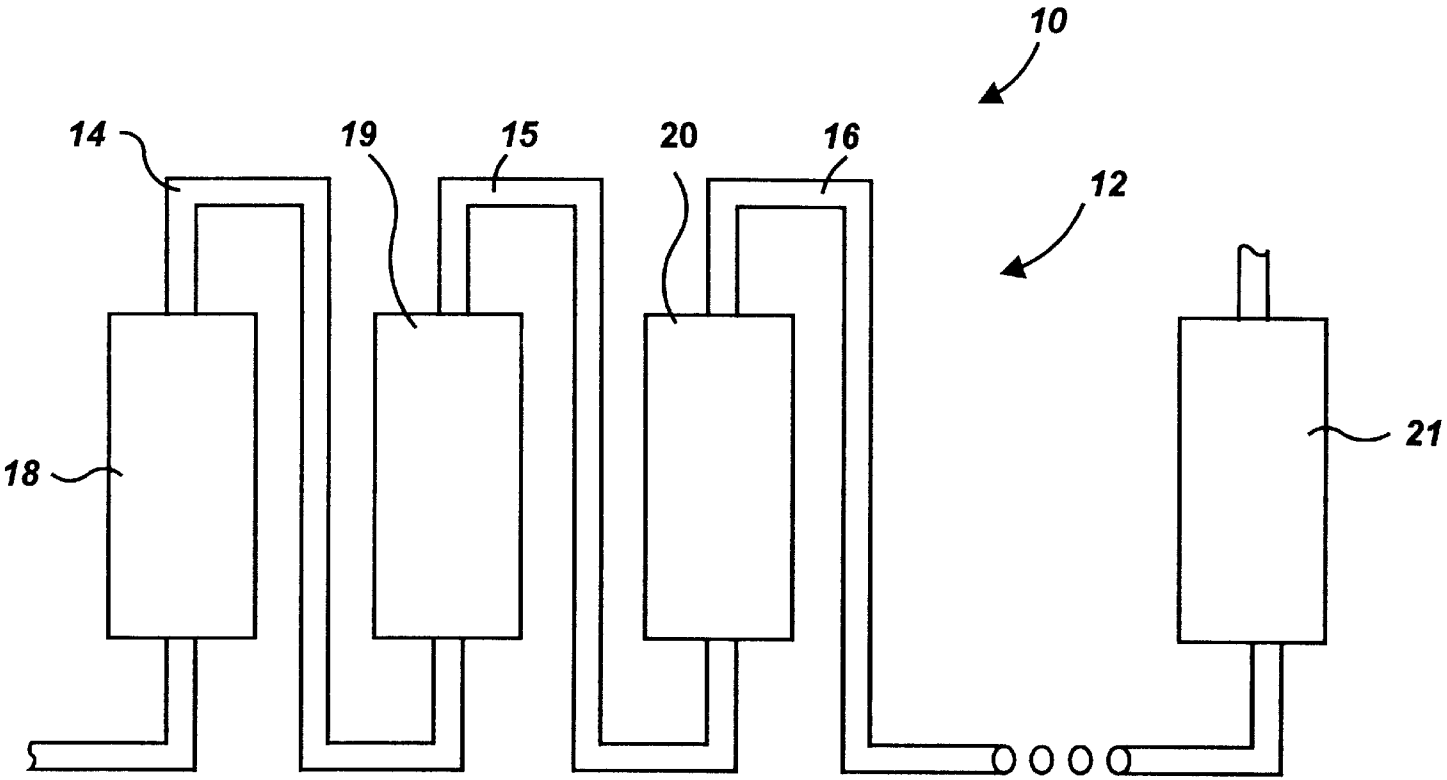
PRIOR ART FIG. 1
FIG. 1 is a schematic view of a prior art frequency scanned microstrip patch array antenna.
Figure 2:
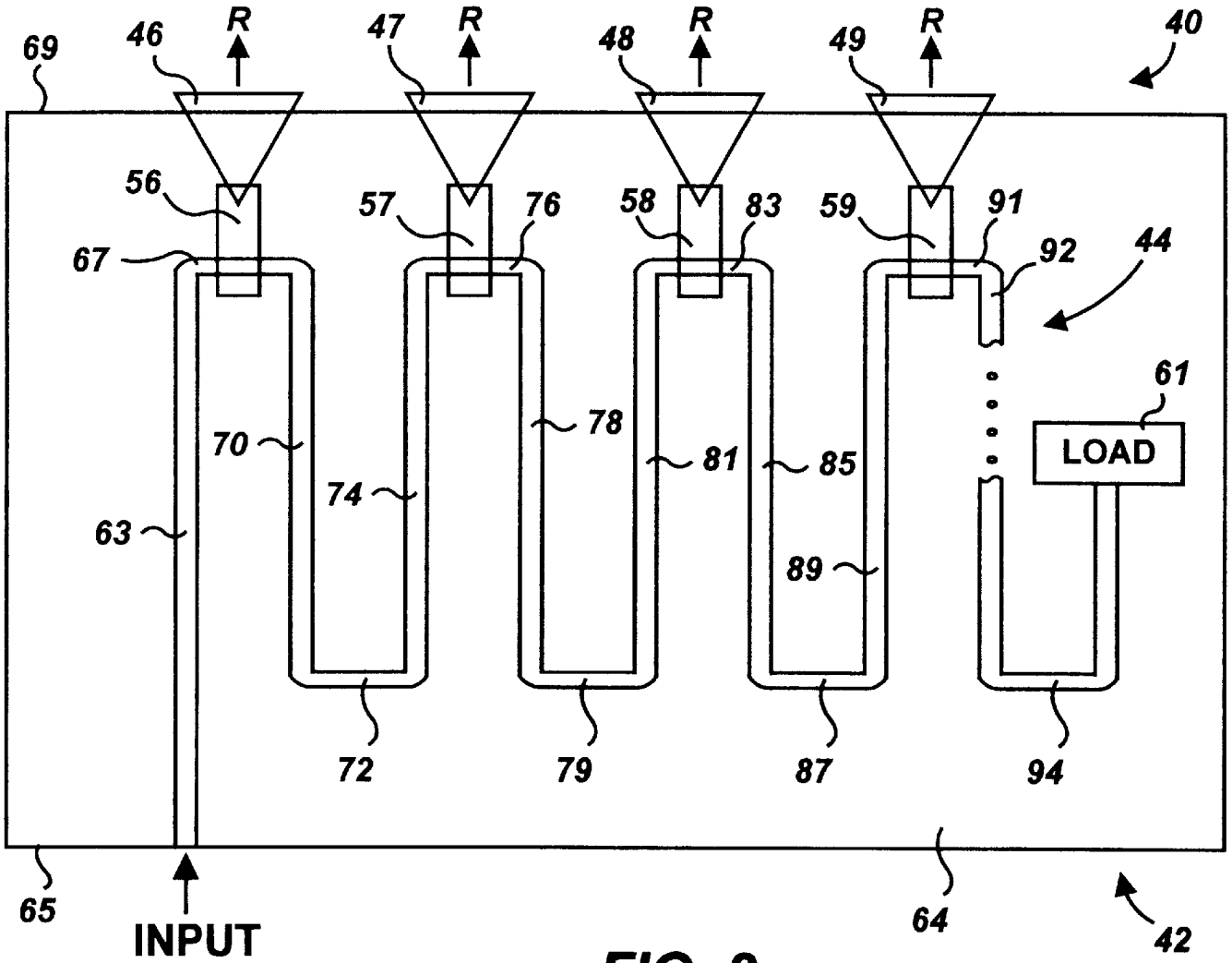
FIG. 2 is a schematic view of a sinuous, frequency-scanned, end-fire, planar, phased-array antenna according to the present invention.

FIG. 2 is a top plan view of a frequency-scanned, end-fire, planar, phased-array antenna 40 according to the present invention. The antenna 40 generally includes a planar board 42 on which a transmission line 44, a plurality of end-fire antennas 46, 47, 48, 49, a plurality of corresponding couplers 56, 57, 58, 59, and a matched load or termination 61 are formed. The number of end-fire antennas 46, 47, 48, 49 and the number of corresponding couplers 56, 57, 58, 59 will depend on the designed electromagnetic performance of the specific application.

The type of planar board 42 used as part of the antenna 40 depends on the kind of transmission line used and the end-fire antennas used. In a preferred embodiment the board 42 is made of a low conductivity microwave dielectric material coated with a highly conductive material. However, in alternative embodiments the board 42 may be made of a conductive material. Representative thin planar surfaces for use as part of the board 42 are: dielectric substrates, ground planes, etc. While the input to the transmission line segment 63 is depicted as being at edge 65 of the board 42, it should be understood that the input may be located on any edge of the board 42 that is convenient for introducing propagating microwave power into the transmission line 44.

In this particular example the board 42 is relatively thin but in other embodiments the thickness of the board 42 may vary depending on the applications for which the antenna 40 is designed and the fabrication techniques used. In a specific exemplary embodiment the board 42 may be a conventional printed circuit (PC) board. While the board 42 is depicted as being flat and rectangularly shaped, it should be understood that other shapes may alternatively be used. For instance, the board 42 may be conformal (i.e., curved or not flat) to a different shape.

The transmission line 44 may be any suitable transmission line, and in particular a planar transmission line or a quasi-planar transmission line. In a preferred embodiment the transmission line 44 is deposited or formed on the upper surface 64 of the board 42, and follows a sinuous path. The transmission line 44 is comprised of a plurality of interconnected segments. The locus of the interconnected segments trace a sinuous, back-and-forth, path on the board 42.

The segments of the transmission line 44 are comprised of an input transmission segment 63 that extends from an edge 65 of the board 42 to a coupling segment 67 disposed in proximity to the edge 69 of the board 42. While the input to the transmission segment 63 is depicted as being at edge 65 of the board 42, it should be understood that this input may be located on any edge of the board 42 that is convenient for introducing propagating microwave power into the transmission line 44. Multiple inputs for multiple transmission lines may optionally be used. The location of the coupling segment 67 relative to the edge 69 may vary with the specific application. One function of the coupling segment 67 as well as the other coupling segments is to provide sections of the transmission line 44 from which energy can be coupled from the transmission line 44 to the end-fire antennas 46–49.

The coupling segment 67 connects the input transmission segment 63 to a transmission segment 70, which, in turn extends in a return segment 72 located in closer proximity to the edge 65. Similarly, but not necessarily identically, the return segment 72 extends in another transmission segment 74 and therefrom in a coupling segment 76, a transmission segment 78, a return segment 79, a transmission segment 81, a coupling segment 83, a transmission segment 85, a return segment 87, a transmission segment 89, a coupling segment 91, a transmission segment 92, and a return segment 94. While only eight transmission segments and eight coupling and return segments are shown, it should be clear to a person of ordinary skill in the field that a different number of transmission segments and corners may alternatively be used. The transmission line 44 terminates in the matched load or termination 61 in order to absorb any remaining power propagating in the transmission line 44 without reflection back along the sinuous transmission line 44.

In this particular example, and for ease of illustration, the transmission segments are shown to be straight (or linear) and parallel relative to each other. It should be clear that these transmission segments may assume different non linear shapes (i.e., curvilinear) and/or may be non parallel. In addition, the coupling segments are shown to have a similar length and to be parallel and disposed at the same distance from the edge 69 of the board 42. It should be clear that the coupling segments are not necessarily equal in length, nor do they need to be parallel or disposed at a fixed distance from the edge 69. It should also be clear that a similar logic applies to the return segments.

In the specific example shown in FIG. 2 the coupling and return segments are shown to be disposed in a normal (i.e., perpendicular) relationship relative to the transmission segments 63, 70, 74, 78, 81, 85, 89, 92. However, in other embodiments it might be advisable to select different angular relationships between the various segments of the transmission line 44. An important, but not an absolute requirement is that the disposition (or angular relationship) among the various segments of the transmission line 44 permit a smooth transition to the propagating wave traveling through the transmission line 44.

An additional desirable criterion for the transmission line 44 is that the coupling segments 67, 76, 83, 91 are designed to be coupled to acceptable couplers as it will be described later. While only the coupling segments 67, 76, 83, 91 are illustrated as being coupled to the couplers 46–49, it should be clear that in an alternative embodiment the return segments 72, 79, 87, 94 may also be coupled to corresponding couplers. In yet another embodiment, some but not all the coupling and return segments are coupled to corresponding couplers.

Some representative planar transmission lines that can be used as the transmission line 44 are: stripline, microstrip line, inverted microstrip line, slot line, coplanar waveguide, coplanar stripline, etc. Some representative dielectric transmission lines that can be used as the transmission line 44 are: image line, insulated image line, inverted strip line, trapped image line, etc. The transmission line segments comprising transmission line 44 need not be all of the same type.

As mentioned previously, the transmission line 44 is coupled at adequate coupling points or segments (i.e., 67, 76, 83, 91), along its length to integrated end-fire antennas 46–49 located in proximity to the edge 69 of the board 42, for radiating in the end-fire direction (or orientation) indicated by the arrows "R". As used herein radiation in the end-fire direction means radiation substantially parallel to the planar surface of the board 42 and emitted from or along the edge 69 thereof.

The couplers 56–59 shown in FIG. 2 are identical. However, in other embodiments the couplers are not necessarily identical and various combinations may be used. As used herein, a coupler is a structure that transfers a certain portion of the power within the transmission line 44 to another structure, which in a preferred embodiment is the end-fire antenna, i.e., 46.

The construction and design of the couplers 56–59 depend on the particular application for which the antenna 40 is used, the particular frequencies used, the particular transmission lines used, the particular end-fine antennas used, etc. Representative couplers include aperture coupled microstrip lines, DeRonde couplers, broadside coupled microstrip lines, etc. The couplers 56–59 need not couple the same amount of power from the transmission line 44, nor do they need to couple the same fraction of power from the transmission line 44. Also, all couplers 56–59 need not be of the same design.

The couplers 56–59 may be coupled to any points along the transmission line 44; however, it is desirable that the coupling points be at those locations along the transmission line 44 such that the propagation direction of the resultant end-fire free space radiation field be related to the frequency of the electromagnetic radiation propagating in the transmission line 44.

In the embodiment shown in FIG. 2 a coupler is coupled to each coupling segment. It should be understood that in other embodiments the couplers may be connected to some but not all of the coupling segments 67, 76, 83, 91.

Considering now the end-fire antennas 46–49, one end-fire antenna is connected to a corresponding coupler. As used herein, an end-fire antenna is capable of emitting radiation into free space or an adjacent substance, substantially in the plane or substantially parallel to the plane of the planar surface of the board 42, from, or in proximity to the edge 69 of the board 42. Representative integrated end-fire antennas are: tapered dielectric rod, Vivaldi antenna, slot antenna, dipole antenna, etc.

In the specific example shown in FIG. 2 the transmission line 44 is shown to be comprised of: transmission line segments 63, 70, 74, 78, 81, 85, 89, 92; coupling segments 67, 76, 83, 91; return segments 72, 79, 87, 94; matched load 61; couplers 56, 57, 58, 59; bends; input. However, in other embodiments one or more additional transmission line elements may be used, depending on the particular design of the antenna 40, such as: impedance transformers, filters, power dividers, adapters, etc.

The end-fire antennas 46–49 are directed in the same orientation. However, in another embodiment the end-fire antennas 46–49 may have different orientations. In a preferred embodiment the end-fire antennas along the edge 69 are adjacent to each other. In order for the end-fire antennas 46–49 to perform efficiently for a particular application the end-fire antennas 46–49 are not spaced farther apart than about one half (½) the free-space wavelength of the radiation emitted by the end-fire antennas 46–49; otherwise, the radiation pattern of the antenna 40 may contain grating lobes.

Figure 6:
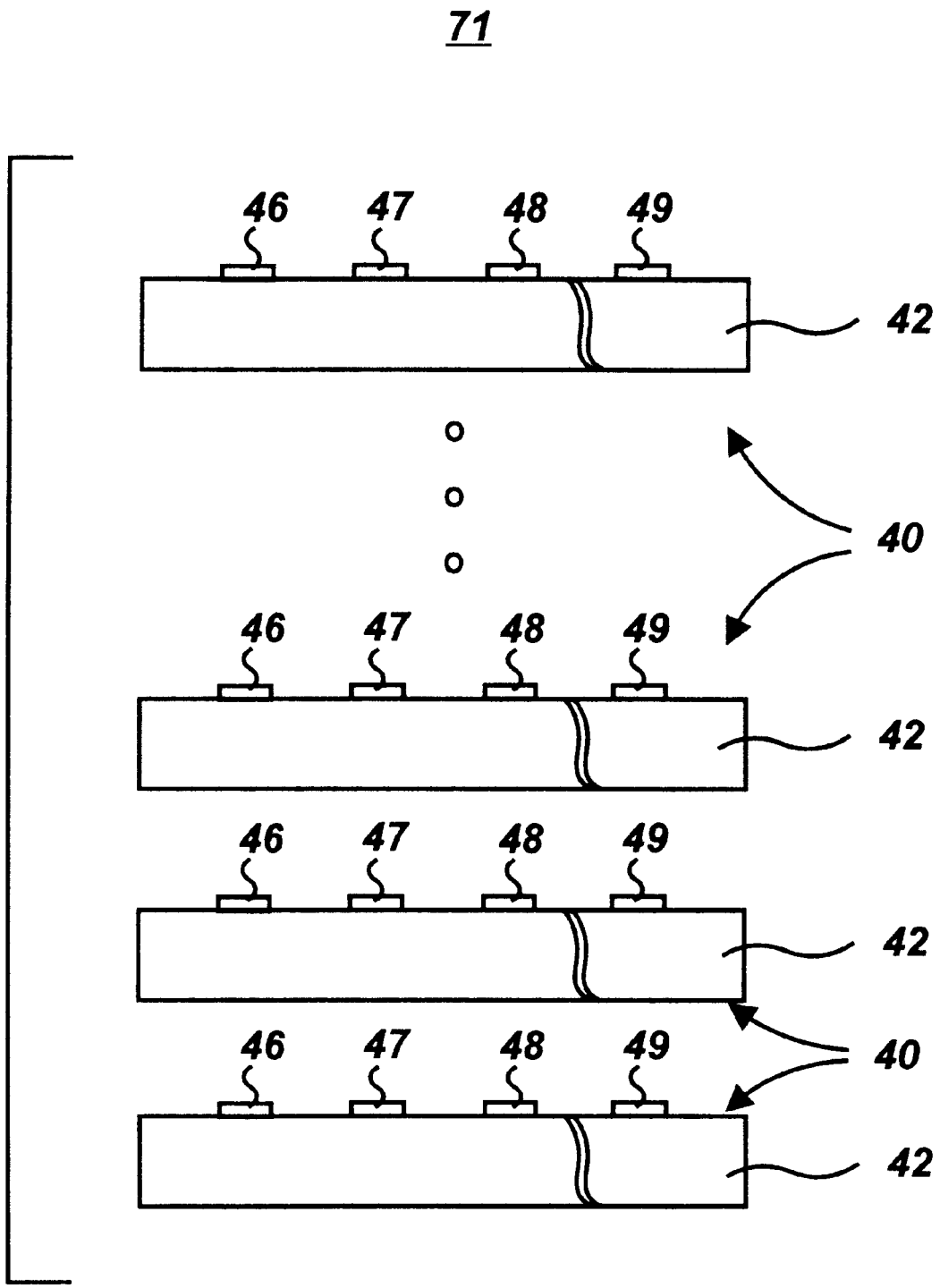
FIG. 6 is a side view of a stack two boards in a multi-dimensional antenna array according to the present invention.

In the present embodiment the antenna 40 uses a single dimensional array, i.e., a single board 42. However, as illustrated in FIG. 6, it is possible to stack two or more boards 42 for obtaining a multi-dimensional (i.e., two-dimensional) antenna array 71. According to one embodiment of the present invention a single dimensional array produces a fan beam, while a multi-dimensional array produces a pencil beam.

In one embodiment according to the present invention the various stacked antennas 40 are connected together and radiate at the same frequency. In another embodiment each antenna 40 in the stack radiates at a different frequency. For instance, and without intent to limit the scope of the invention, one antenna radiates at a frequency "f1", while the remaining antennas radiate at other desirable frequencies "f2", "f3", etc.

In one embodiment the end-fire antennas 46–49 of a two-dimensional array are located along the same side (i.e., edge 69) of the boards 42. However, in alternative embodiments the end-fire antennas may additionally or alternatively be located along one or more other sides (i.e., edge 65).

The concept of the present invention may equally be used to radiate at other than microwave and millimeter-wave frequencies. For instance, the present invention can be used in the terahertz, infrared, and optical frequency ranges by utilizing components, such as transmission lines, couplers, end-fire antennas, matched terminations, amplifiers, etc., designed for those particular frequencies. In one particular embodiment single-mode optical fibers can be used for transmission lines in the infrared frequency range. In another embodiment the antenna 40 is located on a spinning or rotatable platform.

In one exemplary embodiment of the antenna 40 of FIG. 2 the couplers 56–59 and the coupling segments 67, 76, 83, 91 are disposed in substantial alignment with their corresponding end-fire antennas 46–49. As a result, since it would be desirable to position the end-fire antennas 46–49 as close as possible, consistent with the dimension and electromagnetic properties of the end-fire antennas 46–49, but not farther apart than about one half (½) the free-space wavelength of the radiation emitted by the end-fire antennas 46–49, such a limitation would generally equally apply to the coupling segments 67, 76, 83, 91 as well. Consequently, in certain applications the coupling segments 67, 76, 83, 91 and the return segments 72, 79, 87, 94 may form relatively sharp turns with respect to the transmission segments 63, 70, 74, 78, 81, 85, 89, 92, thus causing undesirable radiation from the sharp turns and consequent contamination of the radiation emitted by the end-fire antennas 46–49. In addition, undesirable radiation from sharp turns reduces the power available in the transmission line 44.

Figure 5:
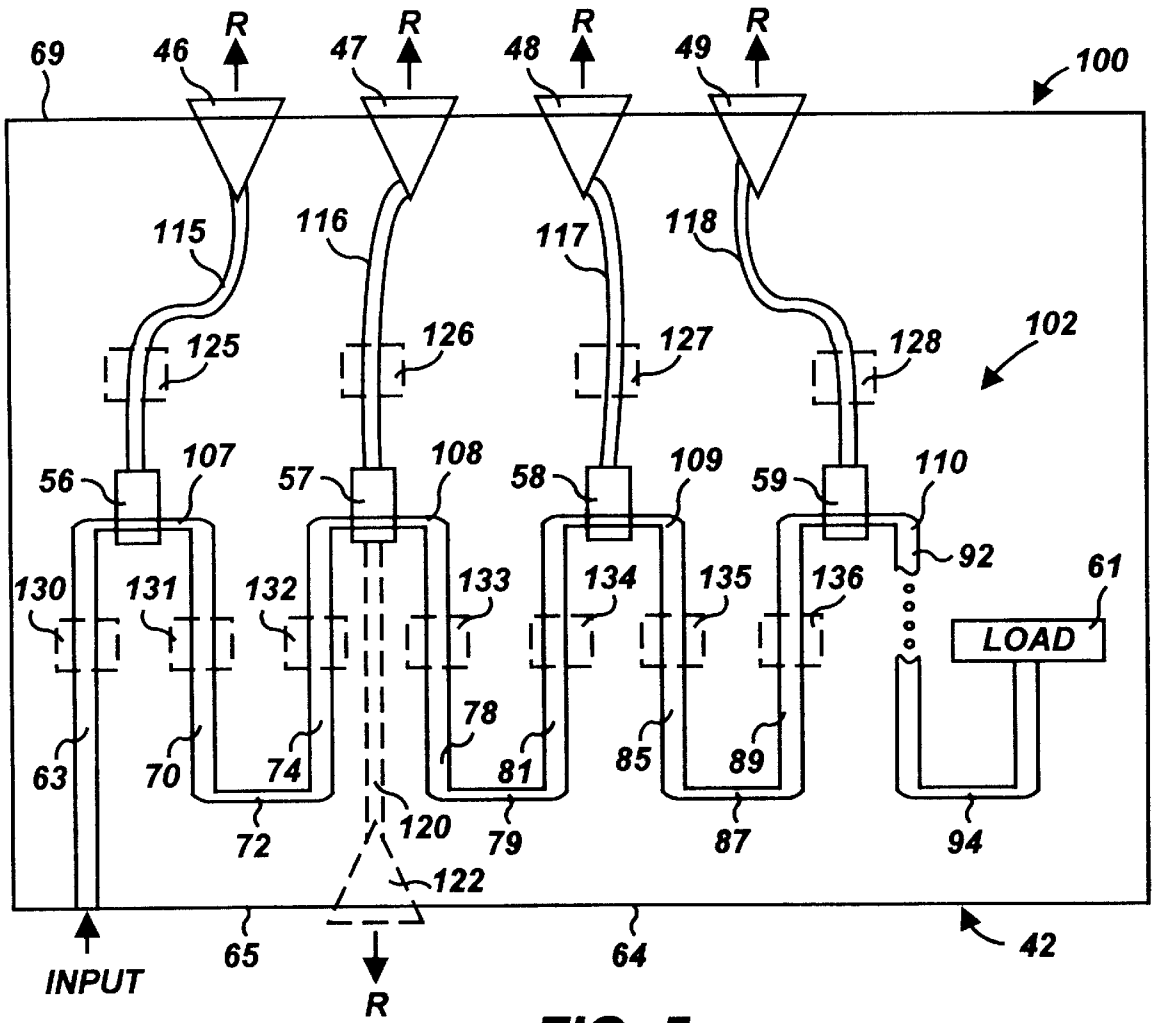
FIG. 5 is a schematic top plan view of another frequency-scanned, end-fire, planar, phased-array antenna according to the present invention.

FIG. 5 illustrates an alternative embodiment of an antenna 100 according to the present invention, with similar components to those of the antenna 40 being similarly referenced. The antenna 100 provides a solution to reduce the necessity for sharp turns within the transmission line 102. In the antenna 100 the end-fire antennas 46–49 are still preferably not farther apart than about one half (½) the free-space wavelength of the radiation emitted by the end-fire antennas 46–49, but the coupling segments 107, 108, 109, 110, as well as the couplers 56–59 are located as far apart as needed to accomplish smooth tums, and hence efficient transmission of the power through the transmission line 102.

This objective is achieved by adding a plurality of connecting transmission lines 115, 116, 117, 118, preferably of equal length. Each connecting transmission line, for instance 115, connects a coupler, for instance 56, to its corresponding end-fire antenna, for instance 46. It is also possible to have two or more connecting lines connected to a single coupler for connecting this coupler to two or more end-fire antennas that may be located either on the same edge (i.e., 69), or on other edges (i.e., 65) of the board 42. For illustration purpose only, the coupler 57 is shown coupled to two connecting transmission lines: a first connecting transmission line 116 connected to the end-fire antenna 46 in proximity to the edge 69, and a second connecting transmission line 120 is connected to another end-fire antenna 122 positioned in proximity to the edge 65. In one embodiment all the connecting transmission lines to the end-fire antennas are equal in length. However, in other designs the connecting transmission lines may have different lengths.

In a preferred embodiment an amplifier is positioned along a connecting transmission line, between a coupler and its corresponding end-fire antenna. The antenna 100 illustrated in FIG. 5 is shown equipped with four amplifiers 125, 126, 127, 128. The gain and phase characteristics of these amplifiers 125–128 may be the same, different or programmable by means of a control chip (not shown).

In another preferred embodiment an amplifier is positioned along a transmission segment of the transmission line 102. For instance, amplifiers 130, 132, 133, 134, 135, 136 are shown connected to the various transmission segments of the transmission line 102. The gain and phase characteristics of these amplifiers 130–135 may be the same, different or programmable by means of a control chip (not shown).

The antennas 40 and 100 of FIGS. 2 and 5, respectively, are described as being formed on one side, i.e, the top side of the board 42. It should be understood that duplicate or similar antennas may additionally be formed on the bottom side of the board 42.

Figure 3:
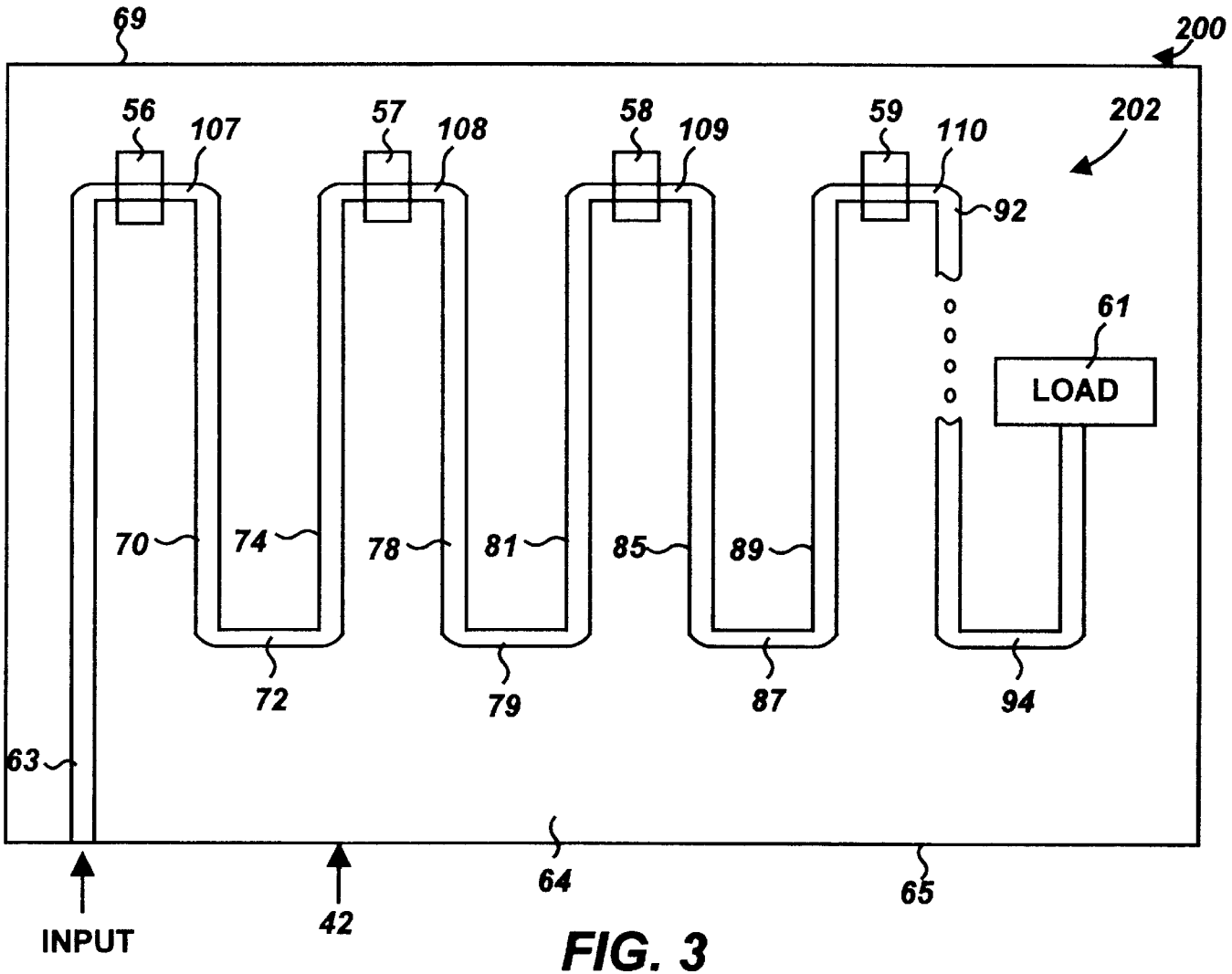
FIG. 3 is a schematic top plan view of an alternative embodiment of a sinuous, frequency-scanned, end-fire, planar, phased-array antenna according to the present invention.
Figure 4:
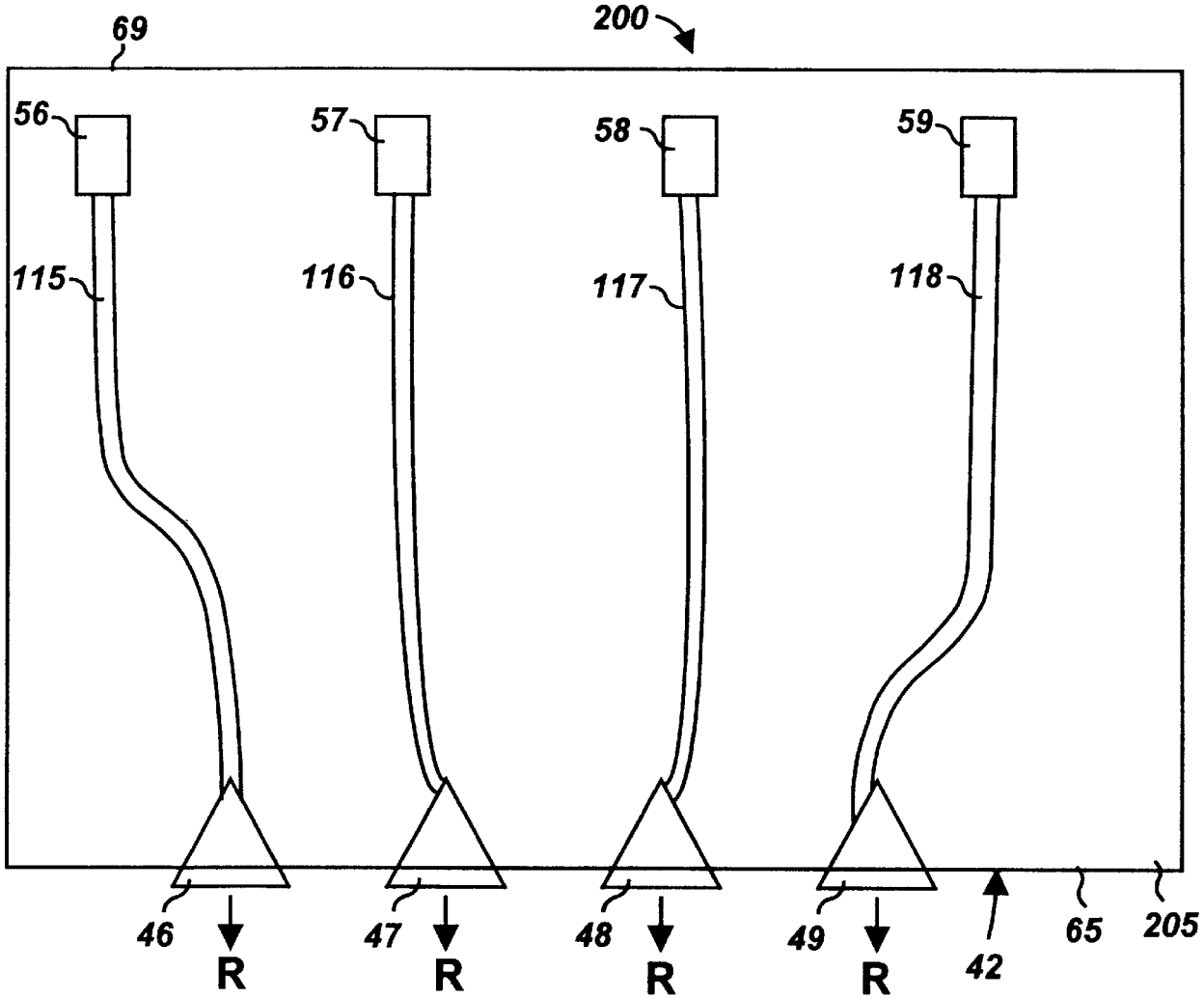
FIG. 4 is the bottom view of the frequency-scanned, end-fire, planar, phased-array antenna of FIG. 3.

FIGS. 3 and 4 illustrate an alternative antenna 200 wherein the sinuous transmission line 202 is formed on the upper surface 64 of the board 42, while the connecting transmission lines 115–118 and the end-fire antennas 46–49 are disposed on the bottom surface 205 of the board 42. The couplers 56–59 extend through the board surfaces 64 and 205 to complete the energy coupling exchange. While the antenna 200 is shown to be a variation of the antenna 100 of FIG. 5, it should be understood that the same or an equivalent concept may be extended to the antenna 40 as well as to other embodiments described herein.

It should be apparent that many modifications may be made to the invention without departing from the spirit and scope of the invention. Therefore, the drawings, and description relating to the use of the invention are presented only for the purposes of illustration and direction. For instance, the present invention may be extended to non-planar phased-array antennas. In addition, while the transmission line has been described as being sinuous, it should clear that linear or non-sinuous transmission lines may be used instead. It is also clear that the condition that the end-fire antennas be not farther apart than about one half (½) the free space wavelength of the radiation emitted by the end-fire antennas can be also achieved by using an interlaced array as described in the book titled "Microwave Scanning Antennas", by R. C. Hansen, Vol. 3, Chapter two, Academic Press, 1966.

What is claimed is:

1. A frequency-scanned, phased-array antenna comprising in combination:

a board having an edge;

a transmission line formed on said board, and having an input;

a plurality of end-fire antennas secured to said board;

a plurality of couplers secured to said board and corresponding to said end-fire antennas;

said transmission line being selectively coupled to said plurality of end-fire antennas via said plurality of couplers, for selectively coupling energy within said transmission line to said end-fire antennas; and wherein said transmission line includes a single, sinuous transmission line in order to enable frequency scanning.

2. The antenna according to claim 1, further including a matched load or termination.

3. The antenna according to claim 1, wherein said input of said transmission line is located at said board edge.

4. The antenna according to claim 1, wherein said board is planar.

5. The antenna according to claim 1, wherein said board is conformal to a non-planar shape.

6. The antenna according to claim 1, wherein said transmission line is planar.

7. The antenna according to claim 1, wherein said transmission line is substantially planar.

8. The antenna according to claim 1, wherein said transmission line includes a plurality of interconnected segments.

9. The antenna according to claim 8, wherein said interconnected segments include a plurality of transmission segments that are connected by a plurality of coupling segments.

10. The antenna according to claim 9, wherein said plurality of couplers are coupled to said plurality of coupling segments.

11. The antenna according to claim 10, wherein said transmission segments include an input transmission segment that extends from said board edge to one of said coupling segments.

12. The antenna according to claim 11, wherein at least some of said transmission segments are linearly shaped.

13. The antenna according to claim 11, wherein at least some of said transmission segments are curvilinearly shaped.

14. The antenna according to claim 8, wherein at least some of said plurality of interconnected segments are of the same type.

15. The antenna according to claim 1, wherein said transmission line is any of: a stripline, a microstrip, an inverted microstrip line, a slotline, a coplanar waveguide, an image line, an insulated image line, a tapped image line, a coplanar stripline.

16. The antenna according to claim 1, wherein each of said end-fire antennas is any of: a tapered dielectric rod, a Vivaldi type antenna, a slot antenna, a dipole antenna.

17. The antenna according to claim 1, wherein said end-fire antennas radiate energy having a predetermined frequency and wavelength;

wherein said end-fire antennas are not farther apart than about one half (½) said wavelength of radiation emitted by said end-fire antennas; and wherein said couplers are located as far apart as needed to accomplish smooth turns of said transmission line.

18. The antenna according to claim 1, further including a plurality of connecting transmission lines; and wherein each connecting transmission line connects a coupler to a corresponding end-fire antenna.

19. The antenna according to claim 18, wherein said board has a first side and second side;

wherein said transmission line is formed on said first side; and said connecting transmission lines are disposed on said second side.

20. The antenna according to claim 1, further including an amplifier positioned along a connecting transmission line, between a coupler and a corresponding end-fire antenna.

21. The antenna according to claim 1, further including an amplifier positioned along a transmission segment of said transmission line.

22. The antenna according to claim 1, wherein said transmission line is single-mode optical fiber.

23. The antenna according to claim 1, wherein at least some of said plurality of end-fire antennas are formed on said board.

24. The antenna according to claim 1, wherein at least some of said plurality of couplers are formed on said board and coupled to corresponding end-fire antennas.

25. The antenna according to claim 1, wherein at least some of said end-fire antennas radiate from said edge, in a direction substantially parallel to a surface of said board.

26. A frequency-scanned, multi-dimensional phased-array antenna comprising in combination:

two or more boards in a stacked relationship, each board having an edge;

a transmission line formed on each of said board; and having an input;

a plurality of end-fire antennas secured to each of said boards;

a plurality of couplers secured to each of said board and corresponding to said end-fire antennas;

said transmission line being selectively coupled to said plurality of end-fire antennas via said plurality of couplers, for selectively coupling energy within said transmission line to said end-fire antennas; and wherein said transmission line includes a single, sinuous transmission line in order to enable frequency scanning.

27. The antenna according to claim 26, wherein the antenna produces a fan beam.

28. The antenna according to claim 26, wherein the antenna produces a pencil beam.

29. The antenna according to claim 26, wherein said boards and corresponding ones of said transmission line, end-fire antennas, and couplers formed on each of said board form separate frequency-scanned antennas; and wherein said frequency-scanned antennas are selectively grouped pursuant to frequency ranges.

30. The antenna according to claim 26, wherein said frequency-scanned antennas radiate at the same frequency.

31. The antenna according to claim 26, wherein said frequency-scanned antennas radiate at different frequencies.

32. The antenna according to claim 26, wherein at least some of said frequency-scanned antennas radiate at a first frequency, and at least some of said frequency-scanned antennas radiate another desirable frequencies.

33. The antenna according to claim 26, wherein at least some of said plurality of end-fire antennas are formed on said board.

34. The antenna according to claim 26, wherein at least some of said plurality of couplers are formed on said board and coupled to corresponding end-fire antennas.

35. A method of making a frequency-scanned, phased-array antenna comprising:

forming a transmission line with an input on a board;

forming a plurality of energy radiating elements in proximity to an edge of said board;

forming a plurality of couplers corresponding to said energy radiating elements on said board;

selectively securing said transmission line to said plurality of energy radiating elements via said plurality of couplers, for selectively coupling energy within said transmission line to energy radiating elements; and wherein forming said transmission line includes forming a single, sinuous transmission line in order to enable frequency scanning.

36. The method according to claim 35, further including stacking two or more boards including said transmission line, plurality of energy radiating elements, and couplers, on top of each other.

37. The method according to claim 35, wherein at least one of the steps of: forming said transmission line, forming said energy radiating elements, and forming said plurality of couplers includes etching said board.

38. The method according to claim 37, wherein the steps of: forming said transmission line, forming said energy radiating elements, and forming said plurality of couplers include etching said board.

39. A frequency-scanned, phased-array antenna comprising:

a first board having an edge;

a first planar-type transmission line formed on said board, and having an input;

a plurality of energy radiating elements formed on said board;

a plurality of couplers formed on said board; and said first transmission line being selectively coupled to said plurality of energy radiating elements via said plurality of couplers, for selectively coupling energy within said first transmission line to said energy radiating elements, and wherein said first transmission line includes a single, sinuous transmission line in order to enable frequency scanning.

40. The antenna according to claim 39, further including a second board with a second transmission line, a plurality of energy radiating elements, and a plurality of couplers formed on said second board; and wherein said first board and second board are secured to each other.

* * * * *